United States Patent [19]

Marsch et al.

[11] 4,408,746

[45] Oct. 11, 1983

[54] HYDRAULICALLY ACTUATED WINCH ASSEMBLY

[75] Inventors: James E. Marsch; Herbert L. Eckert, both of Cedar Rapids, Iowa

[73] Assignee: Harnischfeger Corporation, West Milwaukee, Wis.

[21] Appl. No.: 281,917

[22] Filed: Jul. 9, 1981

[51] Int. Cl.[3] ..... B66D 1/22

[52] U.S. Cl. ..... 254/344; 74/792; 188/71.2; 188/170; 254/356; 254/379

[58] Field of Search ..... 254/344, 297, 356, 375, 254/378, 379; 74/789, 792; 188/71.2, 170, 82.84

[56] References Cited

U.S. PATENT DOCUMENTS

| | | | |
|---|---|---|---|
| 2,890,769 | 6/1959 | Hause | 188/71.2 |
| 3,726,801 | 4/1973 | Sterner et al. | 254/344 X |
| 3,967,706 | 7/1976 | King | 188/170 |
| 4,118,013 | 10/1978 | Christison et al. | 254/344 |
| 4,161,126 | 7/1979 | Winzeler | 254/344 |
| 4,192,405 | 3/1980 | Lee et al. | 188/170 |
| 4,227,680 | 10/1980 | Hrescak | 254/344 |
| 4,328,954 | 5/1982 | Logus | 254/344 |

*Primary Examiner*—John M. Jillions

*Attorney, Agent, or Firm*—James E. Nilles

[57] ABSTRACT

A hydraulically actuated winch assembly having a dual planetary gear system for driving a common ring gear from a power input shaft. Power from the shaft is divided through the two planetary gear systems for driving the common ring gear which is attached to the load member, such as a winch drum. A brake assembly can be assembled as a unit and then inserted into the winch assembly and is axially fixed in position by a retainer plate that is held on the housing of the winch assembly by means of a snap ring. The brake assembly is axially inserted into the housing and against the snap ring and bolt means then are secured between the retainer plate and brake assembly so as to fix the assembly in position within the housing. The brake assembly; includes an axially extending piston rod forming a part of a hydraulic actuator which actuates the brake assembly and the power input shaft for the planetary gear system is piloted in the end of the piston rod. The common ring gear which is driven by the planetary systems is axially secured to the housing by cap screws which in turn are held against inadvertent loosening by the winch drum which is assembled over the cap screws.

7 Claims, 7 Drawing Figures

HYDRAULICALLY ACTUATED WINCH ASSEMBLY

BACKGROUND OF THE INVENTION

The present invention relates generally to rotatable, power driven winches of the type having an internal gear arrangement including planetary gears for driving the winch drum. A prior art type of winch is shown in the U.S. Pat. No. 4,257,577 issued Mar. 24, 1981 and entitled "Motor Vehicle Winch." In that prior art device, as well as others, the planetary gear system required gears of a considerable size and were otherwise difficult to assemble.

SUMMARY OF THE PRESENT INVENTION

The present invention provides a hydraulically actuated winch assembly having a pair of planetary gear systems which are coupled in such a manner that they receive their power from a power input shaft, provide a speed reduction, and divide the transmission of power to a common ring gear which in turn is fastened to the winch drum or other load member. A more specific aspect of the invention relates to a winch assembly of the above type having a brake assembly that can be assembled as a unit before being inserted within the winch assembly. The brake assembly is held in an axial fixed position by means of a retainer plate which has been preassembled within the winch assembly and is held against shifting in one axial direction by a snap ring. The brake assembly is inserted in an end-wise axial direction into the winch drum so that stud bolts which are in the retainer plate pass through the brake assembly. Nuts are tightened on the stud bolts securing the brake assembly to the retainer plate and trapping the snap ring for complete axial retention of the brake assembly.

A more specific aspect relates to a hydraulic actuator for the brake and which includes the piston rod that forms a partial support for the power input shaft. A more limited aspect of the invention relates to a winch assembly of the above type in which the common gear ring is axially secured to the load member by the heads of cap screws which fit in radial clearance holes in the ring gear and are secured to the load member. The cap screws are then held against accidental removal by being trapped by the winch drum which surrounds the cap screws and holds them in position.

These and other objects and advantages of the present invention will appear hereinafter as this disclosure progresses, reference being had to the accompanying drawings.

DESCRIPTION OF A PREFERRED EMBODIMENT

Figure 1:
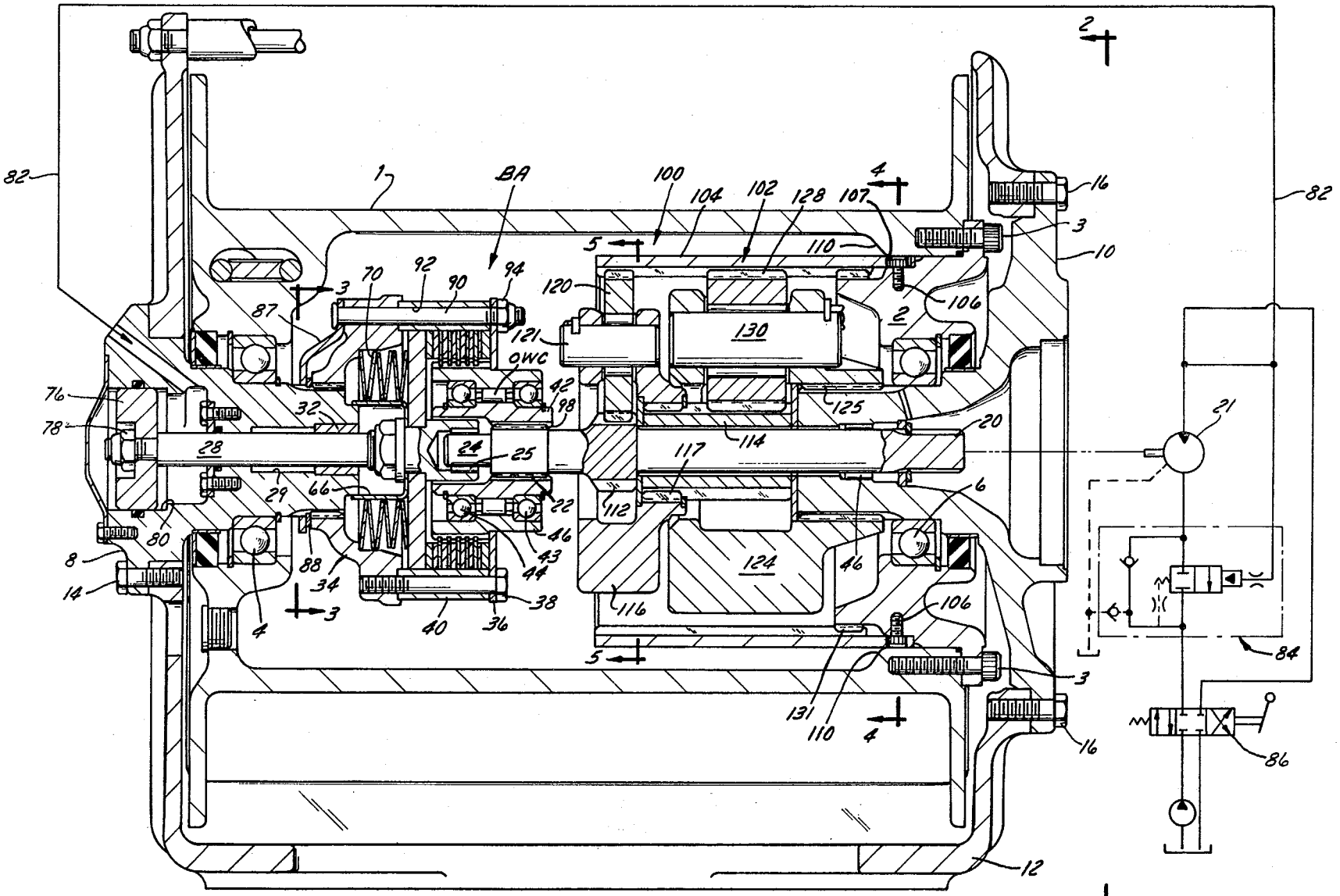
FIG. 1 is a longitudinal cross sectional view through the hydraulic winch embodying the present invention and also showing a schematic hydraulic circuit for furnishing power to the winch.
Figure 3:
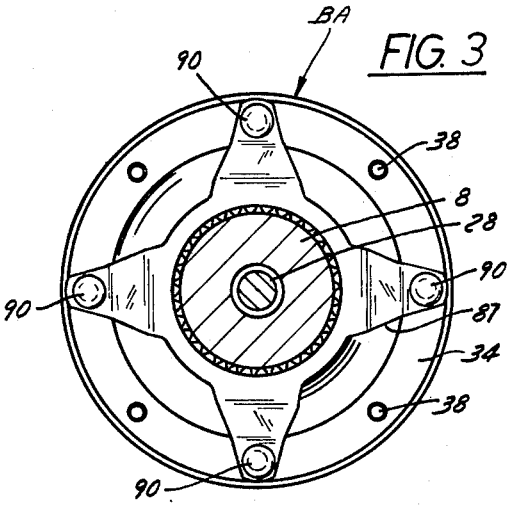
FIG. 3 is a transverse sectional view taken along the line 3—3 in FIG. 1.

The general organization of the hydraulic winch assembly is shown in FIG. 1 and includes a rotatable load member in the form of a cylindrical winch drum 1 around which a cable, not shown, is wound in the conventional manner. A bearing carrier 2 is secured by cap screws 3 to and within one end of the drum, and forms a part of the rotatable drum. The drum is rotatably mounted on anti-friction bearing assemblies 4 and 6 which in turn are fixed by their inner races, respectively, to a bearing support 8 at one end and a bearing support 10 at the other end.

The bearing support 8 and the bearing support 10 are connected together by the housing 12 which is secured to the bearing support 8 by cap screws 14 and to the bearing support 10 by cap screws 16, thereby forming a bearing support housing. The drum is thus rotatably mounted within the housing.

A power input shaft 20 is rotatably journalled in suitable bearings 46 and mounted in the housing, and shaft 20 has splines 22 formed integrally on and adjacent its inner end. Shaft 20 is driven from a power source, such as the hydraulic motor 21. The extreme inner end 24 of the shaft 20 is piloted in an anti-friction bearing 25 mounted within the inner end of an axially extending piston rod 28. The piston rod 28 in turn is journalled in a central axially extending opening 29 in the housing by means of the bushing 32.

Figure 6:
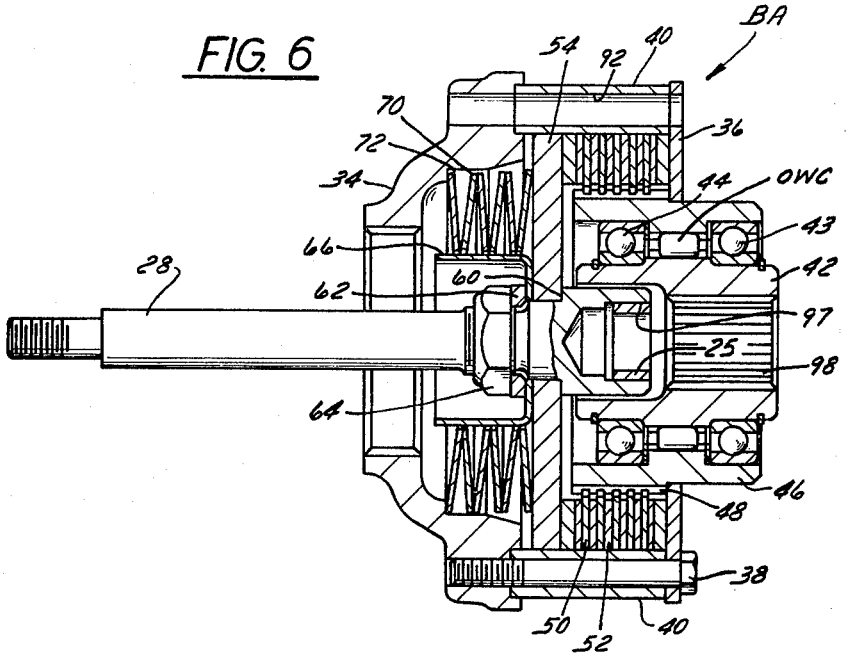
FIG. 6 is a longitudinal sectional view of the brake assembly as shown in FIG. 1, but on an enlarged scale, which assembly is assembled as a unit prior to being inserted in the winch.

The piston rod 28 forms a part of the brake assembly BA shown also in FIG. 6. The brake assembly can be assembled at the bench as a unit, and then can be easily inserted in an axial direction within the winch drum.

The brake assembly BA includes a spider 34 having an end plate 36 rigidly secured thereto by the cap screws 38 and held in spaced apart relationship by the circumferentially spaced spacers 40. An inner hub 42 supports anti-friction bearing assemblies 43 and 44 while an outer hub 46 surrounds the outer bearing race of the anti-friction bearing assemblies. A one-way clutch OWC acts between the inner hub 42 and outer hub 46 to prevent relative rotation of the hubs in one direction, while allowing relative rotation in the opposite direction. The outer hub 46 has a series of external splines 48 formed around its periphery on which are mounted the clutch plates 50 by means of their internal splines that mate with the splines 48. The plates 50 are axially slideable on the splines 48 in the well known manner for driving engagement with hub 46. Another set of clutch plates 52 are interleaved with plates 50, and plates 52 have slots in their outer periphery that are engaged by spacers 40 for driving engagement with spider 34. A clutch release plate 54 is mounted around the inner end of the piston rod 28 and is held captive thereon between a shoulder 60 formed on the piston rod and a washer 62 held captive on the rod by the internally threaded lock nut 64. A cup-shaped belleville spring guide 66 is also held by the washer 62 and nut 64, the latter of which urges the washer 62, spring guide 66 and release plate 54 tightly against the shoulder 60. A series of belleville springs 70 are located around the spring guide and resiliently bear against a shoulder 72 formed internally on the spider and also against the release plate 54. At the outer end of the piston rod is secured a piston 76 held captive thereon by the nut 78 threaded on the end of the piston rod. The piston 76 is in slideable sealing engagement with the chamber 80 which is formed centrally in the end of the bearing carrier. Pressurization of the chamber 80 is provided by fluid pressure from the conduit 82 which is directed to the actuating chamber as desired by the manually operated control valve 86, under influence of the counter balance valve 84.

The brake assembly acts on the inner end of the power input shaft which is opposite from the driven end of the shaft 20, and holds against reverse rotation of the power input shaft 20. Brake torque is, in this manner, transmitted through the end of the shaft 20 which is not subjected to the high number of fatigue cycles encountered by the driven end of the shaft 20. The piston which is external to the winch drum provides a manual means for releasing the brake. This allows lowering of a suspended load which may be trapped in the air due to a malfunction of the engine, pumps or the hydraulic system.

Figure 7:
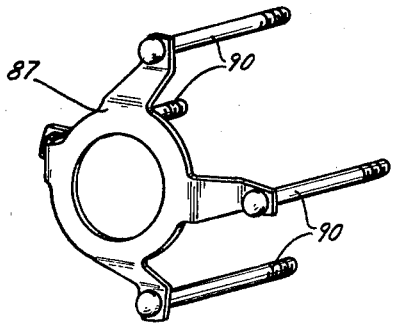
FIG. 7 is a perspective view of the retainer plate shown in FIG. 1 and which permits the brake assembly to be inserted in the winch drum as a complete unit and held captive therein.

The brake assembly, as previously noted, can be assembled as a unit and then assembled into the winch drum. A retainer plate 87 (FIG. 7) is first assembled on the bearing support 8 and retained by snap ring 88. The brake assembly is then inserted in the drum from the right hand side (as viewed in FIG. 1) so that the piston rod is inserted in its bushing 32, and spider 34 abuts against the snap ring. Internal splines formed around the inner periphery of the spider 34 engage external splines formed on the bearing support 8 securing the spider 34 against rotation relative to the housing. Four stud bolts 90 pass through corresponding apertures 92 in the assembly, and nuts 94 are threaded on and tightened. The sleeve bearing 25 (FIG. 6) in the bore 97 in the inner end of rod 28 supports the inner end of the power input shaft 20. The internally splined end 98 of hub 42 is drivingly engaged by the splines 22 of shaft 20.

The retainer plate 87 acts to hold the brake assembly in position and the latter is retained axially in both directions by the single snap ring which is fixed between the retainer plate 87 and the brake spider 34. The retainer plate combines the function of axial retention with that of clamping the brake assembly.

The brake assembly when engaged, together with the one way clutch OWC acts to permit rotation of the power shaft 20 in one direction (generally for raising load) but locks against rotation of the power shaft 20 in the opposite direction (generally for holding a load suspended). When released, the brake assembly permits the power shaft 20 to turn freely in both directions. The brake assembly is released when the actuating chamber 80 is pressurized so that the piston rod and the release plate are urged to the left. The brake assembly is engaged by the belleville springs 70 and thus it is a normally spring engaged, pressure released brake.

The winch assembly provided by the present invention utilizes two planetary gear systems acting between the power input shaft 20 and the drum 1, for raising and lowering a load. The input power from shaft 20 is split between a primary planetary gear system 100 and a second planetary gear system 102, both of which have their planetary gears, as will appear, constantly meshing with a common ring gear 104.

Figure 4:
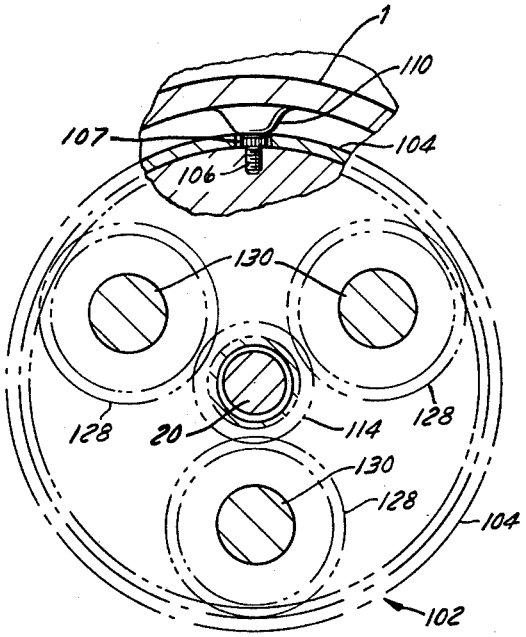
FIG. 4 is a transverse sectional view, generally schematic in nature, taken along the line 4—4 in FIG. 1 and showing the arrangement of the secondary planetary gearing and showing the retaining screws held captive under bosses of the winch drum.
Figure 5:
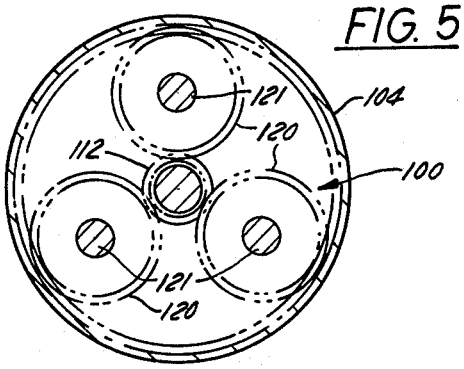
FIG. 5 is a transverse sectional view taken along the line 5—5 in FIG. 1 but on a reduced scale and showing in generally schematic form the primary planetary gears.
Figure 2:
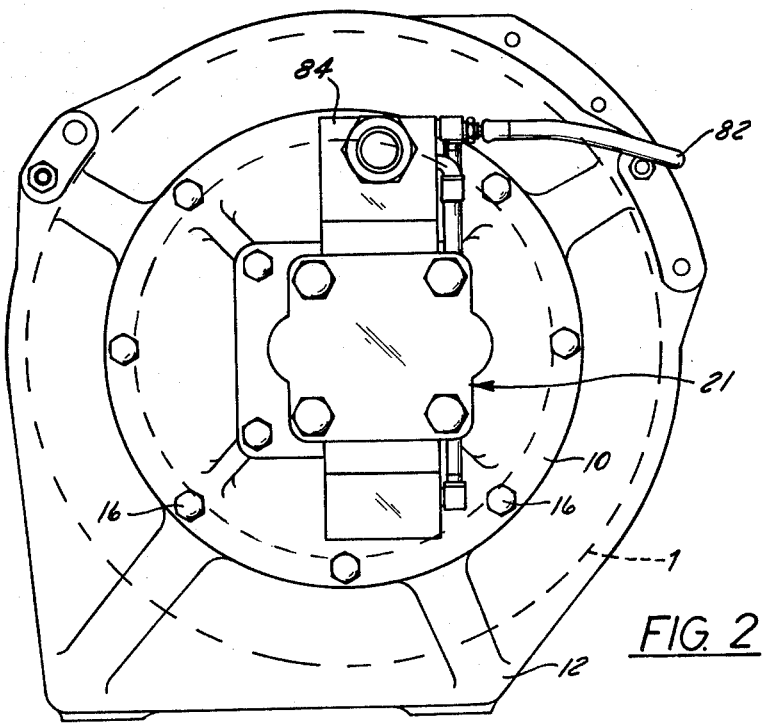
FIG. 2 is a transverse elevational end view of the winch, the view being taken generally from the line 2—2 in FIG. 1.

The common ring gear 104 has internal gear teeth which engage external gear teeth in the bearing carrier 2 to enable the transmission of power to the bearing carrier 2. The common ring gear 104 is secured against axial movement by the heads of cap screws 106 which are radially secured to the bearing carrier 2 through clearance holes 107 (FIG. 4) in the ring gear 104. Cap screws 106 are threadably engaged in bearing carrier 2, and when the winch is assembled, the screws 106 are held captive within the radial clearance holes 107 in the ring gear 104 by the annular boss 110 formed on the interior surface of the winch drum. In other words when the bearing carrier is inserted axially within the drum and the cam screws 3 then tightened in place, the cap screws 106 are prevented from inadvertent loss of the function, i.e., securing the ring gear 104 against axial movement.

The power input shaft 20 has a primary sun gear 112 formed integrally thereon. An axially elongated secondary sun gear 114 is positioned concentric to shaft 20. The primary planetary gear system includes a planet carrier 116 having its internal gear 117 in fixed constant mesh with the external teeth of the secondary sun gear 114. A plurality of circumferentially spaced planetary gears 120 are mounted on the carrier 116 by means of their stub shafts 121 in the known manner and these planetary gears 120 are in constant mesh with the primary sun gear 112 of the power shaft. It will be noted that planetary gears 120 are also in constant mesh with the internal teeth of the common ring gear 104. The secondary planetary system 102 includes a planetary gear carrier 124 fixed by splines 125 to the bearing support 10. A plurality of planetary gears 128 are carried on the carrier 124 by means of respective stub shafts 130. The planetary gears 128 are in constant mesh with the sun gear 114 as well as with the common ring gear 104.

Input power from shaft 20 is split in the primary planetary gear system by the planet gears 120. The majority of the power is transmitted to the planetary gear carrier 116 with the direction of rotation being the same as the input shaft 20. A smaller percentage of the power is transmitted to the common ring gear 104 by the planetary gears 120. Direction of rotation of the common ring gear 104 is opposite to that of the input shaft 20. Power from the primary carrier 116 is transmitted to the secondary sun gear 114 through the carrier gear 117.

Rotation of the secondary carrier 124 is prevented because of the spline connection at 125 to the bearing support 10. Power from the secondary sun gear 114 is transmitted to the common ring gear 104 through the planetary gears 128.

Power which is supplied to the common ring gear 104 from two planetary gear system is then transmitted to the winch drum 1 through the bearing carrier 2 at the spline connection 131 therebetween.

One advantage of the above combination of planetary gear systems is that it is possible to make the gears smaller than for other arrangements where the power flows equally through each planetary system or where a regenerative loop is set up between the primary and second planetary gears. The reduction ratio for this arrangement is:

$$\text{ratio} = 1 - \frac{(R + S1)}{(S1)} \cdot \frac{(R + S2)}{(S2)} \text{ where:}$$

R=the number of teeth in the ring 104
S1=the number of teeth in sun gear 112 on shaft 20
S2=the number of teeth in sun gear 114

With the above arrangement the two planetary systems are coupled with a common ring gear 104 to the output load member. Output power is split between the two planetary systems, allowing the secondary gearing to be smaller. The use of a common ring gear 104 eliminates the necessity of providing a means to couple primary and secondary ring gears together and to the output load member.

I claim:

1. A hydraulically actuated winch assembly comprising a bearing support housing, a winch drum rotatably mounted in said housing, a power input shaft rotatably mounted in said housing and having a primary sun gear formed thereon, a common internally toothed ring gear secured to and within said winch drum, a secondary sun gear concentric to said power input shaft, a primary planetary gear system within said common ring gear and including a planet gear carrier having gear means in fixed constant mesh with said secondary sun gear for delivering power to said secondary sun gear, a plurality of planetary gears rotatably mounted on said carrier and in constant mesh with said primary sun gear of said input shaft and with said common ring gear for delivering power from said input shaft to said common ring gear, a secondary planetary gear system within said ring gear and including a secondary planet gear carrier fixed to said bearing support housing whereby said secondary planet gear carrier is anchored, a plurality of planet gears rotatably mounted on said secondary planet gear carrier and in constant mesh with said secondary sun gear and with said common ring gear for delivering power from said secondary sun gear to said common ring gear, whereby input power from said power input shaft is split between said two planetary gear systems and said power is delivered to said common ring gear for driving said winch drum, a brake assembly mounted within said housing and having a driving connection with said power input shaft, said brake assembly including an interleaved friction plate clutch for forming a releasable driving connection between said power input shaft and said bearing support housing, said brake assembly including spring means for normally urging said clutch into an engaged position to thereby lock said input shaft against rotation, said brake assembly also having hydraulically actuated means for releasing said friction plate clutch and thereby permitting rotation of said power input shaft, and a retainer plate mounted on said bearing support housing and within said drum and held against axial movement in one direction by a snap ring secured in said housing, said brake assembly being insertable in an axial direction in said drum and against said snap ring, and bolt means connected between said retainer plate and said brake assembly whereby the latter is axially fixed within said drum by said snap ring and can be assembled as a unit prior to insertion in said drum.

2. The assembly set forth in claim 1 including, a one-way clutch located between said power input shaft and said friction plate clutch and arranged when said brake assembly is engaged to permit rotation of said power input shaft in one direction and prevent rotation of said power input shaft in the opposite direction.

3. The winch assembly set forth in claim 1 further characterized in that said brake assembly includes an axially extending piston rod forming a part of said hydraulically actuated means; and said power input shaft has an inner end which is piloted in an inner end of said piston rod.

4. The winch assembly set forth in claim 1 including a bearing carrier secured to said drum and rotatable therewith, said common ring gear being secured by its internal teeth to said bearing carrier, cap screws threadly engaged in said drum, said ring gear having clearance holes through which said cap screws extend to prevent axial movement of said common ring gear, said winch drum having an internal surface bearing against said cap screws when said winch assembly is assembled to thereby prevent inadvertent removal of said cap screws.

5. A dual planetary gear system for rotatably driving a load and comprising, a non-rotatable housing, a load member rotatably mounted in said housing, a power input shaft rotatably mounted in said housing and having a primary sun gear formed thereon, a common internally toothed ring gear secured to said load member, a secondary sun gear concentric to said power input shaft, a primary planetary gear system within said common ring gear and including a planet gear carrier having gear means in fixed constant mesh with said secondary sun gear for delivering power to said secondary sun gear, a plurality of planetary gears rotatably mounted on said carrier and in constant mesh with said primary sun gear of said input shaft and with said common ring gear for delivering power from said input shaft to said common ring gear, a secondary planetary gear system within said ring gear and including a secondary planet gear carrier fixed to said bearing support housing whereby said secondary planet gear carrier is anchored to said housing, a plurality of planet gears rotatably mounted on said secondary planet gear carrier and in constant mesh with said secondary sun gear and with said common ring gear for delivering power from said secondary sun gear to said common ring gear, whereby input power from said power input shaft is split between said two planetary gear systems and said power is delivered to said common ring gear for driving said load member, a brake assembly mounted within said housing and having a driving connection with said power input shaft, said brake assembly including an interleaved friction plate clutch for forming a releasable driving connection between said power input shaft and said housing, said brake assembly including spring means for normally urging said clutch into an engaged position to thereby lock said input shaft against rotation, said brake assembly also having hydraulically actuated means for releasing said friction plate clutch and thereby permitting rotation of said power input shaft, and a retainer plate mounted on said housing and within said load member and held against axial movement in one direction by a snap ring secured in said housing, said brake assembly being insertable in an axial direction in said load member and against said snap ring, and blot means connected between said retainer plate and said brake assembly whereby the latter is axially fixed within said load member by said snap ring and can be assembled as a unit prior to insertion in said load member.

6. A brake assembly for being axially inserted in and mounted within a housing which has a central axially extending opening therein, said brake assembly including (1) an axially shiftably and extending piston rod insertable in said opening and having a clutch release plate secured thereto, (2) an interleaved friction plate clutch engageable by said release plate, (3) spring means for normally urging said clutch into an engaged position, (4) hydraulically actuated means including said piston rod and plate for releasing said friction plate clutch, (5) a retainer plate mounted in said housing and held against axial movement in one direction by a snap ring secured in said housing, said brake assembly being insertable in an axial direction in said housing and against said snap ring, (6) and bolt means connected between said retainer plate and said brake assembly whereby the latter is axially fixed by said snap ring and can be assembled as a unit prior to insertion in said housing.

7. A hydraulically actuated winch assembly comprising a bearing support housing, a winch drum rotatably mounted in said housing, said drum including a bearing carrier secured thereto and located within said drum, said carrier having an anti-friction bearing for rotatably supporting said drum, said carrier having an externally toothed portion extending axially in said drum, an internally toothed ring gear having internal teeth and secured to said axially extending portion of said carrier by said internal teeth, said ring gear adapted to drivingly mesh with a planetary gear system locatable within said ring gear, said ring gear having clearance holes extending therethrough, cap screws extending radially through said clearance holes in said ring gear and into said carrier to axially secure said ring gear to said carrier, said ring gear and said carrier being axially insertable into one end of said drum, means for securing said carrier to said drum, the inner surface of said drum surrounding and abutting against said cap screws to hold the latter captive against inadvertent removal.

* * * * *